US009029726B2

(12) United States Patent
Cernat

(10) Patent No.: US 9,029,726 B2
(45) Date of Patent: May 12, 2015

(54) GAS BLAST CIRCUIT BREAKER

(75) Inventor: Radu-Marian Cernat, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 214 days.

(21) Appl. No.: 13/697,627

(22) PCT Filed: May 3, 2011

(86) PCT No.: PCT/EP2011/057010
§ 371 (c)(1),
(2), (4) Date: Nov. 13, 2012

(87) PCT Pub. No.: WO2011/141321
PCT Pub. Date: Nov. 17, 2011

(65) Prior Publication Data

US 2013/0056444 A1 Mar. 7, 2013

(30) Foreign Application Priority Data

May 12, 2010 (DE) ..... 10 2010 020 979

(51) Int. Cl.
*H01H 33/18* (2006.01)
*H01H 33/91* (2006.01)
*H01H 33/90* (2006.01)

(52) U.S. Cl.
CPC ..... *H01H 33/91* (2013.01); *H01H 2033/908* (2013.01)

(58) Field of Classification Search
CPC .... H01H 33/904; H01H 33/905; H01H 33/88
USPC ..... 218/43, 53, 60
See application file for complete search history.

(56) References Cited

U.S. PATENT DOCUMENTS

| | | | | |
|---|---|---|---|---|
| 8,546,716 | B2 * | 10/2013 | Nufer et al. | 218/43 |
| 2003/0173335 | A1 * | 9/2003 | Dufournet et al. | 218/43 |
| 2008/0314873 | A1 * | 12/2008 | Dahlquist et al. | 218/53 |
| 2009/0078680 | A1 * | 3/2009 | Franck et al. | 218/60 |
| 2009/0107957 | A1 * | 4/2009 | Drews et al. | 218/53 |
| 2009/0261071 | A1 * | 10/2009 | Nufer et al. | 218/81 |

FOREIGN PATENT DOCUMENTS

| | | | |
|---|---|---|---|
| DE | 31 27 962 | A1 | 1/1983 |
| DE | 40 18 169 | A1 | 12/1991 |
| DE | 200 15 563 | U1 | 1/2002 |
| DE | 10 2005 008 098 | A1 | 9/2005 |
| EP | 1 548 780 | A1 | 6/2005 |
| JP | 2000-311561 | A | 11/2000 |

* cited by examiner

*Primary Examiner* — Truc Nguyen
(74) *Attorney, Agent, or Firm* — Laurence A. Greenberg; Werner H. Stemer; Ralph E. Locher

(57) ABSTRACT

A circuit breaker includes a first contact and a second contact. An electric arc zone is disposed between the contacts. A feed channel opens into the electric arc zone, connecting the electric arc zone to a hot gas reservoir volume. The hot gas reservoir volume, in turn, is connected to a compression volume. An outflow opening is disposed in a wall of the compression volume. The outflow opening is permanently open, at least in a contacting state of the contacts.

5 Claims, 3 Drawing Sheets

GAS BLAST CIRCUIT BREAKER

BACKGROUND OF THE INVENTION

Field of the Invention

The invention relates to a gas-blast circuit-breaker with an arc zone arranged between a first contact and a second contact and connected to a hot gas reservoir volume via a feed channel, wherein the hot gas reservoir volume is connected to a variable compression volume by means of an overflow channel, and with a wall incorporating at least one outflow opening which delimits the compression volume.

A gas-blast circuit-breaker of this type is described e.g. in the utility model specification DE 20015563 U1. The gas-blast circuit-breaker described therein is provided with a first contact and a second contact, with an arc zone arranged between the two. Within the arc zone, means are provided for the conduction of an electric arc. The arc zone is connected via a feed channel to a hot gas reservoir volume which, in turn, is connected to a variable compression volume. The hot gas reservoir volume is connected to the compression volume by means of an overflow channel. A wall which encloses the compression volume is also provided with an outflow opening.

The hot gas reservoir volume is designed to accommodate hot gas which is generated during a switching operation. Depending upon the switching operation concerned, the quantity of gas generated may vary. Accordingly, circumstances may arise in which a large quantity of hot gas is injected into the hot gas reservoir volume, resulting in a substantial rise in the internal pressure of the hot gas reservoir volume. The outflow opening in the compression volume is closed by means of a pressure relief valve. When a specific pressure in the compression volume is achieved, the outflow opening is opened.

The pressure relief valve fitted to the outflow opening is subject to both thermal and mechanical loading, thereby resulting in the potential wear of the pressure relief valve. In consequence, the outflow opening must be subject to regular maintenance, and the pressure relief valve fitted thereto must be serviced or replaced.

BRIEF SUMMARY OF THE INVENTION

Accordingly, the object of the invention is the disclosure of a gas-blast circuit-breaker which permits the reduction of expenditure on maintenance.

The object according to the invention is fulfilled by a gas-blast circuit-breaker of the type described in the introduction, wherein the outflow opening is permanently open, at least in the contacting state of the contacts.

Gas-blast circuit-breakers are electrical switching devices which are used for the interruption of currents. A circuit-breaker is capable of the reliable and multiple interruption of both rated currents and fault currents, such as short-circuit currents. Specifically in the high-voltage and extra high-voltage ranges, in order to allow the reduction of insulating clearances, pressurized gas may be advantageously used for insulation purposes in a circuit-breaker. Gas-blast circuit-breakers are provided with an interrupter unit for the guidance and positioning of the contacts. The interrupter unit is flushed and surrounded by an electrically insulating gas (insulating gas) which is subject to an increased pressure (pressurized gas). This raised pressure enhances the dielectric strength of the gas such that differing electrical potentials within a limited installation space can be reliably insulated from each other by the pressurized insulating gas. Gas-blast circuit-breakers are provided with an enclosure, within which the interrupter unit is positioned. The interior of the enclosure is filled with the highly pressurized insulating gas. The pressure of the insulating gas is higher than that of the medium which surrounds the enclosure, and may be as high e.g. as several bar. Sulfur hexafluoride has proved to be particularly advantageous as an electrically insulating gas. However, other appropriate electrically insulating gases, such as nitrogen, or gas mixtures incorporating nitrogen and/or sulfur hexafluoride etc., may also be used.

In addition to electrical insulation, the pressurized gas also delivers a support function for an action executed by the gas-blast circuit-breaker during a switching operation. A gas-blast circuit-breaker is provided with at least a first contact and a second contact, with an arc zone arranged between the two. The two contacts may be configured e.g. as arcing contacts, which are electrically connected in parallel to first and second rated current contacts respectively. The design of the arcing contacts is such that, during a closing operation, the latter will form a galvanic contact in advance of the rated current contacts. Conversely, upon a breaking operation, the arcing contacts remain in galvanic contact for a longer period than the rated current contacts. Accordingly, upon a closing operation, the arcing contacts operate in advance and, upon a breaking operation, operate in arrears of their associated parallel-connected rated current contacts respectively. In a configuration of this type, it is possible to achieve the preferential conduction of an electric arc between the arcing contacts, such that the latter protect the rated current contacts against erosion, and serve for the conduction and direction of the arc. It is therefore possible for the rated current contacts to be optimized in respect of their optimum load rating, whereas the arcing contacts can be optimized in respect of their arc erosion resistance in response to the thermal effects of electric arcing.

However, the contacts can also assume the functions of both electric arc conduction and rated current conduction. This form of construction is particularly advantageous in cost-effective switching devices, which are subject to only limited requirements in respect of their switching capacity. Regardless of whether the contacts are configured as separate arcing contacts and separate rated current contacts, or as a combination of arcing contacts and rated current contacts, provision should be made to the effect that, during a switching operation, the contacts move in relation to each other. To this end, at least one of the contacts is arranged to move in relation to the other contact. However, it is also possible for both arcing contacts to be configured in a moveable arrangement such that, upon a breaking operation or a closing operation, the rate of contact separation and the rate of contact engagement respectively can be straightforwardly increased.

During a closing operation, electric arcing may occur as the two contacts move closer together (pre-arcing). Contact arcing may occur between the contacts within the arc zone. The associated thermal effects result in the heating of the insulating gas within the arc zone. This insulating gas is heated and, as it expands, becomes "hot switching gas" or "hot gas". Hot gas should be evacuated from the arc zone and cooled or subject to interim storage. During a closing operation, galvanic contact between the two contacts occurs upon the completion of the closing operation, such that any pre-arcing will naturally be extinguished.

The situation in case of a breaking operation, i.e. an operation for the interruption of a current-carrying current circuit, is significantly more complex. The input of thermal energy to the circuit-breaker associated with a breaking arc is substantially proportional to the value of the current to be interrupted, and to the burn time of a breaking arc. Upon breaking, the two contacts are galvanically separated. Even with a fast rate of contact separation, it is scarcely possible to achieve the immediate extinction of the electric current generated by a potential difference in the current circuit to be interrupted. In many cases, electric current will continue to flow in the arc zone in the form of an electric arc. Only for exceptionally short times, i.e. those times at which e.g. as a result of the oscillation of the current or voltage e.g. in an alternating current system the current passes through zero, will only a small arc or no arcing at all occur upon the separation of the contacts. In many cases, however, contacts are separated at a random point in time, at which no natural extinction of the current will generally occur. Specifically in case of breaking operations in response to a fault, interruption must be effected as rapidly as possible. In general, conditions of oscillation at that time are not relevant.

In many cases, a flaming arc occurs in the arc zone upon a breaking operation. As the electric arc burns in the arc zone, it expands the electrically insulating gas which surrounds it and erodes other components of the gas-blast circuit-breaker in its immediate vicinity. As a result, a plasma cloud is formed around the electric arc in the arc zone, comprised of heated electrically insulating gas and vaporized materials such as plastics or metals. For the extinction of the electric arc, this plasma cloud must be removed from the arc zone as quickly as possible. The flow conditions required for this purpose are generated by the routing of the electrically insulating gas, converted into hot gas by the heat of the electric arc, into the hot gas reservoir volume via the feed channel. The more powerful the electric arc, i.e. the higher the current to be interrupted, and the longer the burn time of the electric arc, the more hot gas will be driven into the hot gas reservoir volume by the electric arc, thereby raising the pressure in the hot gas reservoir volume. The feed delivered by the electric arc is such that no direct backflow from the hot gas reservoir volume is possible. Specifically, it may be advantageously provided that the feed channel may be closed or open, depending upon the relative position of the contacts to each other. To this end, it is possible to use e.g. an insulating material nozzle for the guidance, direction and limitation of the flaming arc, wherein a channel, e.g. a bottleneck in the insulating material nozzle, may be closed by one of the contacts. Accordingly, it is also possible for the flow of the hot switching gases into the feed channel to be controlled by the relative position of the contacts to each other. In addition to the raising of the internal pressure in the hot gas reservoir volume, a variable compression volume is provided, which delivers an increase of pressure by the compression of insulating gas within the said compression volume. The gases contained in the compression volume and the hot gas reservoir volume may communicate via an overflow channel such that, e.g., the mixing of gas contained in the compression volume and the gas contained in the hot gas reservoir volume may be possible. It is therefore possible, e.g., for electrically insulating gas in the compression volume to be predominantly compressed at a lower temperature and transferred to the hot gas volume, where it will have a cooling effect upon the hot gas.

By the opening of an outflow channel, it is possible for the highly pressurized gas in the hot gas volume and in the compression volume to flow into the arc zone via the feed channel. The electric arc, which is still burning in the arc zone at this point, is then immersed in the backflow of gas from the feed channel and the plasma cloud is displaced out of the arc zone, while the arc is cooled and blasted, ultimately resulting in the interruption of the electric arc and the corresponding interruption of the current flow in the current circuit to be interrupted.

Gas-blast circuit-breakers are used for the switching of currents of any value, up to the magnitude of short-circuit currents. A circuit-breaker must therefore be capable of the reliable interruption, e.g., not only of a rated current, but also of a short-circuit current. However, the current flowing in the circuit-breaker may only represent a fraction of the rated current. The reliable interruption of all these currents must be possible. On the grounds that, regardless of the magnitude of the current to be interrupted, the ignition of a breaking arc must be anticipated, the circuit-breaker must generate a sufficient volume of pressurized gas for the immersion of a breaking arc, whatever the switching operation concerned.

In the case of low currents, no above-average build-up of pressure in the hot gas volume is to be anticipated. However, specifically in response to rated currents or short-circuit currents, the intensity of the electric arc may be such that rupture limits of the hot gas reservoir volume or the compression volume may be achieved. In this case, any surplus gas must be discharged via the outflow opening, in order to restrict the build-up of pressure in the hot gas volume or compression volume. If it is arranged that the outflow opening is permanently open, at least in the contacting state of the contacts, there is a continuous exchange of gases between the interior of the compression volume and the adjoining areas of the interrupter unit or the interior of the enclosure. This results in a continuous inflow and outflow of gases. At this point, under any circumstances, a connection will exist between the compression volume and the surrounding areas via the outflow opening. Accordingly, there is no pressure difference between the compression volume and the area which communicates with the latter via the outflow opening. This prevents any unwanted "preloading" of the compression volume by the action of pre-compression.

It may be advantageously provided that the outflow openings will close no earlier than the time at which the galvanic separation of the contacts is achieved, i.e. the closure of the outflow opening coincides with the potential ignition of an electric arc. It may also be provided that the closure of the outflow opening coincides with the time of opening of the feed channel, i.e. the time at which the backflow of the previously expanded hot gas contained in the hot gas reservoir volume commences. As the feed channel opens, the hot gas reservoir volume can be evacuated and, accordingly, the outflow opening may also be closed at this time.

However, it may be advantageously provided that the outflow opening is permanently open.

In this case, an outflow opening in one wall of the compression volume must be provided which, regardless of the relative position of the contacts to each other, constitutes a permanent opening in the wall of the compression volume. A structural arrangement of this type is manifestly counterproductive to the mode of operation of a variable compression volume on the grounds that, via a permanently open outflow opening, the escape of pressurized gas from the interior of the compression volume, at a more or less rapid rate, may be anticipated. By the incorporation of one or more outflow openings of appropriately sized cross-section, the relatively rapid release of overpressure in a gas which has previously been compressed by the adjustment of the volume of the compression volume can be achieved accordingly. By the corresponding reduction of this cross-section, the release of pressure can be slowed down accordingly.

The hot gas reservoir volume and the compression volume may be connected to each other by means of an overflow channel. Via the overflow channel, it is possible for quantities of gas to be transferred from one of these volumes to the other. By the arrangement of the outflow opening in the compression volume, overpressure protection for the upstream hot gas reservoir volume can be provided via the outflow opening in the compression volume.

The stroke of the variable compression volume is controlled by the mechanical design of the gas-blast circuit-breaker. Regardless of the value of the current to be interrupted, the same compressive pressure is maintained in the compression volume by the mechanical adjustment of this volume. However, the filling of the hot gas reservoir volume with hot gas varies in proportion to the rating of the current to be interrupted and the power of the flaming arc. Currents of low rating are associated with only the limited charging of the hot gas reservoir volume. Currents of higher rating, such as short-circuit currents, are associated with the correspondingly greater fullness of the hot gas reservoir volume. It is therefore possible, e.g. in the case of relatively low currents, which are associated with only the limited charging of the hot gas reservoir volume, that the blasting of an arc can essentially be achieved by the action of the variable-volume compression device, whereas the hot gases generated by the electric arc and contained in the hot gas reservoir volume are of secondary significance. Conversely, a high breaking capacity, i.e. for a high current which generates a correspondingly powerful arc, is associated with the over-proportional charging of the hot gas reservoir volume with hot switching gases and a correspondingly over-proportional pressure increase in the hot gas reservoir volume. Once the feed channel is open and the blasting of the arc ensues, i.e. gases contained in the hot gas reservoir volume or the compression volume flow back in the direction of the arc zone, it is essentially the switching gases stored in the hot gas reservoir volume which effect the immersion of the high-current electric arc, whereas the compressed gases contained in the compression volume are of secondary significance.

In a further advantageous configuration, a differential pressure-controlled valve may be arranged in the course of the overflow channel.

By the use of a differential pressure-controlled valve, it is possible to allow the escape of the switching gases stored in the hot gas reservoir volume, which are at a correspondingly higher pressure than the compressed insulating gases in the compression volume, into the arc zone via the feed channel. This pressure differential is such that any overflow of compressed insulating gas from the compression volume into the hot gas reservoir volume, and thereafter into the arc zone via the feed channel, can be prevented. Only after the hot gas reservoir volume has been discharged, i.e. the pressure in this volume has fallen below a limiting pressure, can the pressurized insulating gas contained in the compression volume flow into the hot gas reservoir volume, and from thence into the arc zone via the feed channel. However, where the electric arc to be interrupted is of limited power only, it may not be possible for a sufficient overpressure to be generated within the hot gas reservoir volume such that, in this case, the pressurized insulating gas contained in the compression volume flows directly into the hot gas reservoir volume, and from thence via the feed channel into the arc zone, where it immerses and cools the low-current arc burning in this zone and displaces the plasma cloud from the arc zone.

For the control of differential pressure, a corresponding valve unit may be arranged on the overflow channel, which will open or close the channel in accordance with the pressure differential between the hot gas reservoir volume and the compression volume.

It may also be advantageously provided that the flow resistance of the permeable overflow channel is equal to or lower than the flow resistance of the open outflow opening.

By the dimensioning of the flow resistances of the overflow channel and the outflow opening, it is possible for outflow control to be achieved without the use of any valves on the outflow opening. Accordingly, by the use of an overflow channel with a lower, and specifically with a significantly lower, flow resistance than the flow resistance of the outflow opening(s), it may be arranged that the outflow of compressed insulating gas contained in the compression volume via the outflow opening is negligible, and that adequate compression can be achieved within the compression volume. This makes it possible for the outflow opening to be kept free of any moving components which might result in the obstruction of the outflow opening.

It may also be advantageously provided that the compression volume is enclosed by a piston which is moveable in relation to the wall, such that the outflow opening is intermittently closed by the piston.

The compression volume is a mechanical compression device, the volume of which is adjusted to achieve the compression and pressurization of insulating gas contained therein. The compression volume is provided with a piston, which is moveable in relation to one wall. The travel of the piston relative to the wall can be used to effect the path-controlled closure of the outflow opening. In this way, it is possible for the time of closure of the outflow opening to be synchronized with the time of contact separation or opening of the feed channel, the achievement of a specific contact gap, etc. To this end, the motion of the piston may be synchronized with the relative movement of the contacts to each other by means of a corresponding gearing arrangement. In the simplest case, a kinematic chain is provided between the piston and one of the contacts, which is moveable in relation to the other. A path-controlled arrangement has a further advantage, in that the outflow opening is closed by components which are required for other purposes. Any additional valves or similar elements can therefore be omitted, and a robust construction is provided.

It may advantageously be provided that the wall is configured as a regular cylindrical shell surface of the compression volume.

The compression volume may be provided e.g. with a regular cylindrical shell surface. A moveable piston of matching profile is arranged in the interior of this shell surface for displacement in the longitudinal cylinder axis of the regular cylindrical shell surface. Where the outflow opening is arranged in a shell surface, the position of the outflow opening in the shell surface can be used to set the time at which the said opening will close, according to the relative position of the piston. Accordingly, it is also possible e.g. for a number of outflow openings to be closed in a staggered sequence, thereby allowing the flow resistance of the outflow openings as a whole to be variably adjusted as a switching operation proceeds. In this way, the pressure build-up in the compression volume can be configured in a number of ways. By the appropriate cross-sectional dimensioning of the outflow openings, e.g. with a large number of outflow openings in the open position, the effectiveness of the compression device at the start of a compression stroke can be reduced, whereas, as an increasing number of outflow openings are closed, the compressive effect of the compression device is increased.

It may also be advantageously provided that the wall is configured as an end face of the compression volume, arranged opposite the piston in the direction of motion thereof.

By the accommodation of the outflow opening in an end-face wall, it is possible for the outflow opening to remain permanently in the open position in the compression device, regardless of the position of the compression piston in the compression device, thereby providing an outlet for the pressure relief of the compressed electrically insulating gas contained within the compression volume at any time. It is therefore possible e.g. for an opening for the outflow of compressed electrically insulating gas from the compression volume to be made available by the outflow opening even upon the achievement of the end position, i.e. the position associated with maximum compression.

An example of embodiment of the invention is schematically represented in the diagrams, and is described in greater detail thereafter.

BRIEF DESCRIPTION OF THE SEVERAL VIEWS OF THE DRAWING

In the diagrams.

DESCRIPTION OF THE INVENTION

Figure 1:
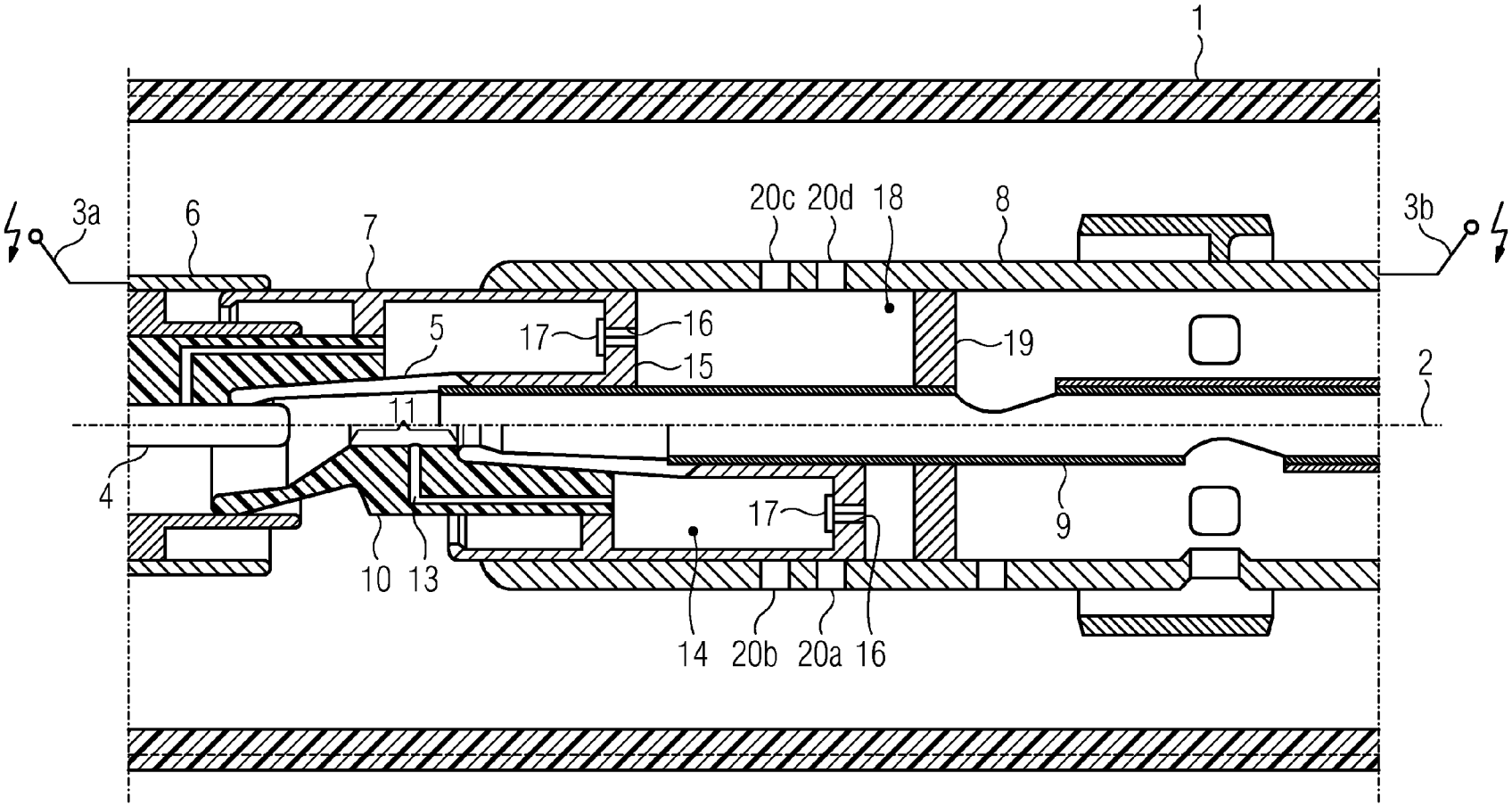
FIG. 1 shows a partial cross-section of a first variant for the embodiment of a gas-blast circuit-breaker.
Figure 2:
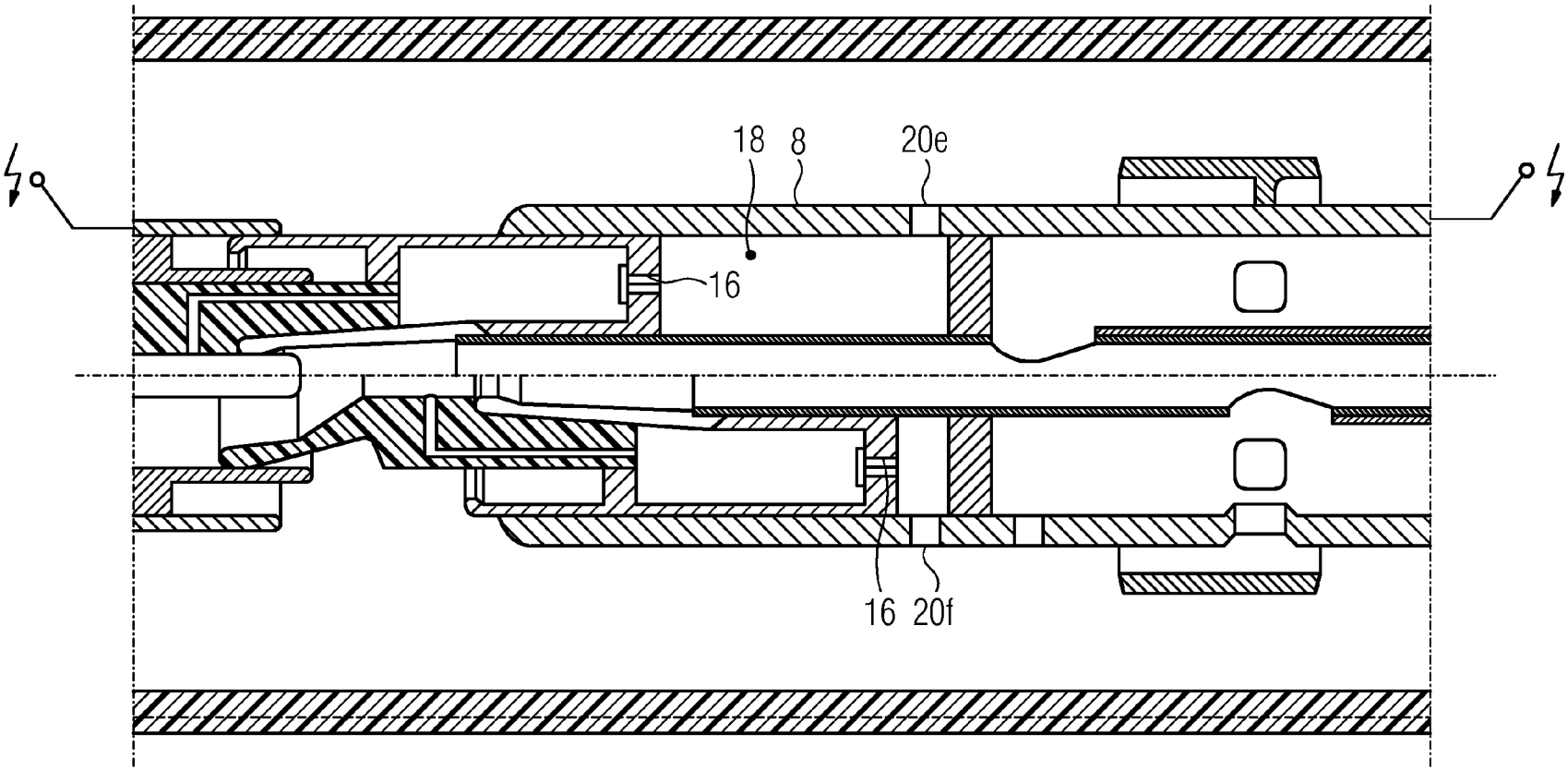
FIG. 2 shows a partial cross-section of a second variant for the embodiment of a gas-blast circuit-breaker.
Figure 3:
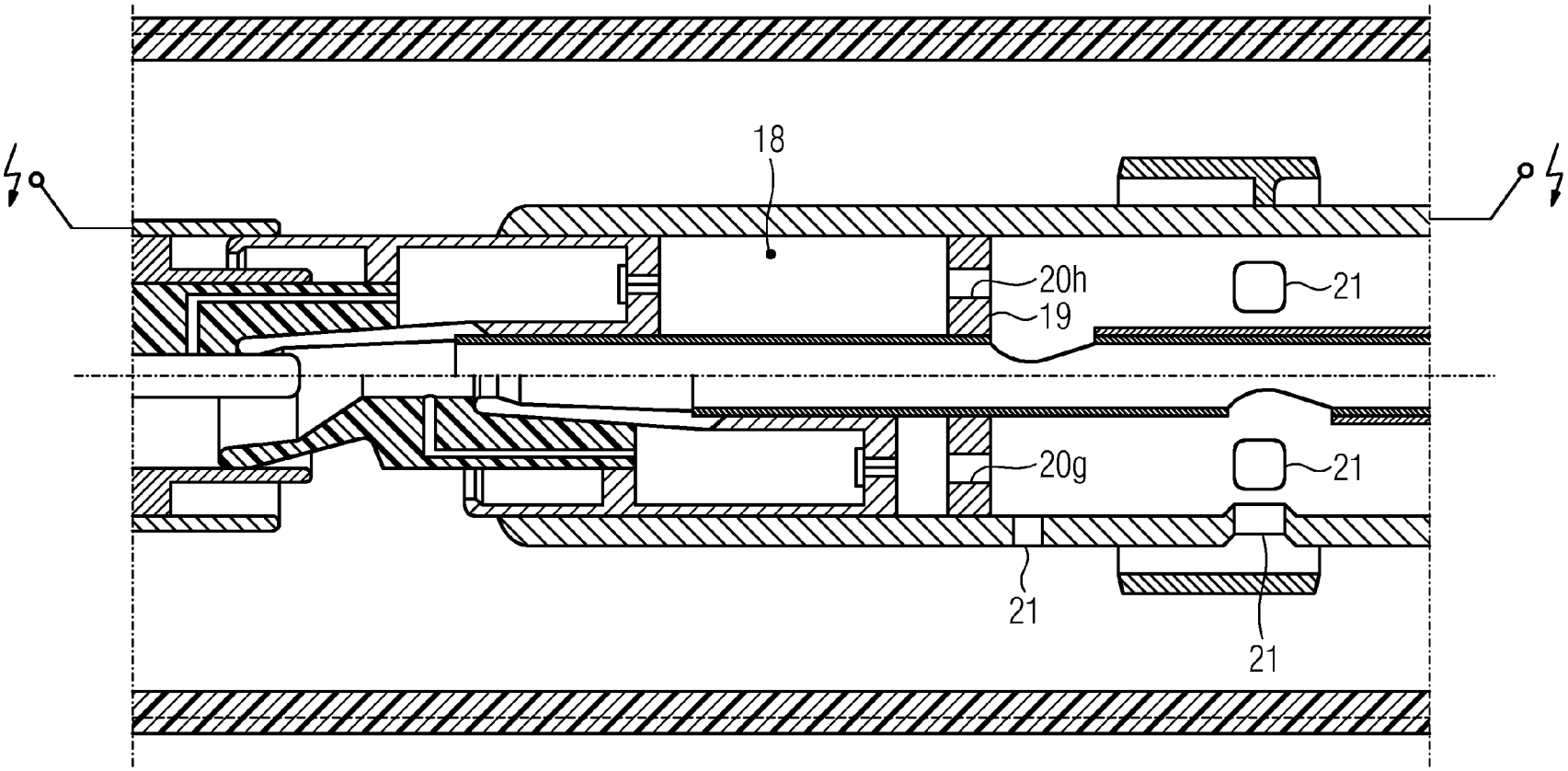
FIG. 3 shows a partial cross-section of a third variant for the embodiment of a gas-blast circuit-breaker.

The construction and operation of a gas-blast circuit-breaker is firstly described with reference to the examples shown in FIGS. 1, 2 and 3. In FIGS. 1, 2 and 3, the same reference figures are used for equivalent structural elements, and alternative reference figures are only used to designate variations in detail.

All three figures are divided into a first half-image and a second half-image along an axis of symmetry 2. In each of the figures, the first half-image represents a gas-blast circuit-breaker in the closed position, and the second half-image represents a gas-blast circuit-breaker in the open position.

FIG. 1 shows part of a gas-blast circuit-breaker in cross-section. The gas-blast circuit-breaker is provided with an enclosure 1. In this case, the enclosure 1 is configured in an essentially tubular form, and is arranged coaxially to an axis of symmetry 2. In this case, an enclosure 1 comprised of an insulating material is represented. However, an enclosure 1 of an electrically conductive material may also be provided. An interrupter unit for the gas-blast circuit-breaker is arranged in the interior of the enclosure 1. The interrupter unit is configured in an essentially coaxial arrangement to the axis of symmetry 2. Where an electrically insulating enclosure 1 is used, as represented in FIG. 1, the interrupter unit rests directly on the enclosure, whereby electrical terminals 3*a*, 3*b* are routed through the enclosure 1 in a fluid-tight arrangement. The interrupter unit is fully enclosed by the enclosure 1, which forms a gas-tight barrier. In a form of embodiment of the enclosure 1 in which the latter is configured as an electrically conductive enclosure, the interrupter unit is separated from the enclosure 1 and electrically insulated by means of an insulating arrangement. Correspondingly, the terminals 3*a*, 3*b* are electrically insulated for the purposes of the routing thereof through an electrically conductive enclosure. Outdoor bushings, for example, may be used for this purpose. Regardless of the construction thereof, the terminals 3*a*, 3*b* penetrate the barrier formed by the enclosure in a fluid-tight arrangement.

A configuration of a gas-blast circuit-breaker with an electrically insulating enclosure 1 is described as a live-tank gas-blast circuit-breaker. A configuration of a gas-blast circuit-breaker with an electrically conductive enclosure is described as a dead-tank gas-blast circuit-breaker. An enclosure of this type may consist e.g. of a metal material, which provides conduction to a ground potential.

The interior of the enclosure 1 is filled with an electrically insulating gas. The electrically insulating gas is at a higher pressure than the medium which surrounds the enclosure 1. The electrically insulating gas is e.g. sulfur hexafluoride, nitrogen or another appropriate gas. The interior of the enclosure 1 is completely suffused by the electrically insulating gas. The enclosure 1 forms a gas-tight barrier. The insulating gas contained within the enclosure 1 may show an overpressure to a value of several bar, and suffuses and flushes all the components contained within the enclosure 1. Accordingly, the gas also suffuses the elements of the interrupter unit.

The design of the interrupter unit arranged in the interior of the enclosure 1 may be assumed to be essentially uniform, regardless of the type of enclosure 1 concerned. In this case, the interrupter unit is provided with a first contact 4 and a second contact 5. The first contact 4 and the second contact 5 are moveable in relation to each other along the axis of symmetry 2. In this case, the first contact 4 is configured as a fixed contact, while the second contact 5 is arranged for displacement in the axis of symmetry 2 of the enclosure 1. Conversely, however, it may also be provided that the first contact 4 is a moveable contact and the second contact 5 is a fixed contact, or that both contacts 4, 5 are configured as moveable contacts. In this case, the first contact 4 is configured in the form of a stud, whereas the second contact 5 is configured as a diametrically opposing bush. The first contact 4 is coaxially enclosed by a first rated current contact 6. The first rated current contact 6 and the first contact 4 are connected in an electrically conductive arrangement, such that the first contact 4 and the first rated current contact 6 show the same electrical potential at all times. The second contact 5 is enclosed by a second rated current contact 7. The second contact 5 and the second rated current contact 7 are also connected in an electrically conductive arrangement, such that the second rated current contact 7 and the second contact 5 show the same electrical potential at all times. In common with the first contact 4, the first rated current contact 6 is stationary in relation to the enclosure 1. The second contact 5 and the second rated current contact 7 are connected in a rigid angular arrangement, by means of their electrically conductive connection, such that a relative movement of the second contact 5 to the first contact 4 also results in a relative movement of the second rated current contact 7 to the first rated current contact 6. In this case, the first rated current contact 6 is configured in the form of a bush, such that a contact can be formed by the insertion of the second rated current contact 7 into the bushing recess of the first rated current contact 6. It may also be provided that the first rated current contact 6 is moveable in relation to the enclosure 1, and that the second rated current contact 7 is fixed in relation to the enclosure 1. It may also be provided that both the first rated current contact 6 and the second rated current contact 7 are moveable in relation to the enclosure. The selection of a moveable or stationary arrangement for the two contacts 4, 5 and the two rated current contacts 6, 7 may proceed as required. By the movement of both contacts 4, 5 or both rated current contacts 6, 7, which are arranged for movement in opposite directions, the speed of contact separation during a breaking operation, or the speed of contact closure during a closing operation, can be increased.

An electrically conductive contact is formed between the first terminal 3*a* and the first rated current contact 6, which is stationary in relation to the enclosure 1. The first rated current contact 6 is provided with a cylindrical outer shell surface, and engages with a guide bush 8. The guide bush 8 is stationary in relation to the enclosure 1. The second rated current contact 7 is arranged for displacement in the guide bush 8 along the axis of symmetry 2. Between the second rated current contact 7 and the guide bush 8, a sliding electrical contact arrangement, which is not shown in greater detail in the diagram, is provided in a joint gap, such that an electrically conductive contact is formed by the guide bush 8 with the second rated current contact 7, and thereafter with the second contact 5. The second terminal 3*b* is connected to the guide bush 8 in an electrically conductive arrangement. Accordingly, a current circuit is formed from the first terminal 3*a* via the first rated current contact 6, the first contact 4 and the second rated current contact 7 respectively, the second contact 5 and the guide bush 8 respectively to the second terminal 3*b*, which may be interrupted or closed by means of the gas-blast circuit-breaker.

The two rated current contacts 6, 7 form a rated current circuit, which must be configured with the minimum possible impedance, such that the contact resistance within the interrupter unit of the gas-blast circuit-breaker is as low as possible. The two contacts 4, 5 act as arcing contacts. During a breaking operation, the rated current contacts 6, 7 are separated first. The current flow switches to the contacts 4, 5 which are still closed. Upon the separation of the contacts 4, 5, the ignition of an electric arc may occur. The electric arc is routed by the contacts 4, 5. Accordingly, the two contacts 4, 5 are designed and configured to provide high contact erosion resistance.

The end of the second contact 5, configured as a bush, which lies closest to the first contact 4 is provided with a number of elastically deformable contact fingers. The contact fingers lie in frontal contact with a drive pipe 9. The drive pipe 9 is configured coaxially to the axis of symmetry 2 and arranged for displacement along the axis of symmetry 2. An insulating material nozzle 10 is arranged on the second rated current contact 7. The insulating material nozzle 10 is provided with a rotationally symmetrical form, and arranged coaxially to the axis of symmetry 2. The insulating material nozzle 10 is connected to the second rated current contact 7 in a rigid angular arrangement and, accordingly, can move in tandem with the motion of the second rated current contact 7. The insulating material nozzle 10 surrounds the contact fingers of the second contact 5 and extends beyond the latter in the direction of the first contact 4. The insulating material nozzle 10 is provided with a bottleneck 11, which extends frontally in front of a bushing recess in the second contact 5. The bottleneck 11 is configured as an essentially cylindrical recess, which runs coaxially to the axis of symmetry 2. The cross-section of the bottleneck 11 is matched to the cross-section of the first contact 4, whereby the cross-section of the bottleneck 11 is slightly larger than the cross-section of the first contact 4. The end of the insulating material nozzle 10 which projects from the second rated current contact 7 cooperates, in a rigid angular arrangement, with a support bush 12 which is connected to the first rated current contact 6. The insulating material nozzle 10 slides inside the support bush 12 during the completion of a switching operation. An arc zone, for the preferential routing of an electric arc, is arranged between the two contacts 4, 5. An electric arc may occur during either a closing or a breaking operation, whereby the combustion of the arc from its associated root points will ideally proceed on the two contacts 4, 5. In order to ensure the correct timing of the switchover on the contacts 4, 5, in case of a closing operation, the closure of the two contacts 4, 5 precedes the closure of the two rated current contacts 6, 7. In case of a breaking operation, the separation of the two rated current contacts 6, 7 precedes the separation of the contacts 4, 5, i.e. the contacts 4, 5 are configured with a time lag in relation to the rated current contacts 6, 7. The arc zone extends between the two contacts 4, 5, or surrounds the two contacts 4, 5. In this case, the arc zone also includes the interior of the bottleneck 11 in the insulating material nozzle 10. The arc zone is connected to a hot gas reservoir volume 14 by means of a feed channel 13. In this case, the feed channel 13 passes through the insulating material nozzle 10. The feed channel 13 may be provided in the form of an annular channel which runs through the insulating material nozzle 10, thereby dividing the insulating material nozzle 10 into an inner section and an outer section. However, it may also be provided that one or more channels run through one wall of the insulating material nozzle 10 and discharge into the bottleneck 11. The hot gas reservoir volume 14 runs coaxially to the axis of symmetry 2 and, in this case, is configured in an essentially regular cylindrical form. The hot gas reservoir volume 14 runs coaxially to the axis of symmetry 2, lies on the circumference of the second contact 5 and is enclosed by the second rated current contact 7. Accordingly, the hot gas reservoir volume 14 is configured in the form of an annular space, which is penetrated by the drive pipe 9 and is radially enclosed by the second rated current contact 7. On one end face, in which the feed channel 13 discharges into the hot gas reservoir volume 14, the hot gas reservoir volume 14 is also enclosed by the insulating material nozzle 10. At the opposite end, the end face is configured as a partition 15. An overflow channel 16 is arranged in the partition 15. In this case, the overflow channel 16 is provided in the form of a number of bores in the partition 15, whereby the said bores run parallel to the axis of symmetry 2. In this case, the overflow channel 16 is arranged for closure by means of a differential pressure-controlled valve, specifically a one-way valve 17.

The partition 15 is configured as a piston, which is arranged for longitudinal displacement within the guide bush 8 in the axis of symmetry 2. The piston encloses a variable compression volume 18. The piston accommodates the hot gas reservoir volume 14 in its interior. The compression volume 18 extends from the arc zone in the direction of the axis of symmetry 2, behind the hot gas reservoir volume 14. Similarly to the hot gas reservoir volume 14, the compression volume 18 is configured with a hollow cylindrical form, wherein the shell-side enclosure of the compression volume 18 is provided by the guide bush 8. The inner shell-side enclosure of the compression volume 18 is provided by the drive pipe 9. The partition 15 and the drive pipe 9 are connected to each other in a rigid angular arrangement. The partition 15 forms a moveable end-face enclosure of the compression volume 18. The compression volume 18 is also provided with a stationary end wall 19. The stationary end wall 19 is connected to the guide bush 8 in a rigid angular arrangement. The stationary end wall 19 is penetrated by the drive pipe 9, and the drive pipe 9 is moveable in relation to the stationary end wall 19. A number of outflow openings 20*a*, 20*b*, 20*c*, 20*d* are arranged in the shell surface of the compression volume 18, i.e. in one wall of the guide bush 8. The positions of the outflow openings 20*a*, 20*b*, 20*c*, 20*d* in the wall of the guide bush 8 may be selected as required. The number of outflow openings 20*a*, 20*b* 20*c*, 20*d* is also variable. However, the total flow resistance of the outflow openings 20*a*, 20*b*, 20*c*, 20*d* is greater than the flow resistance of the overflow channel 16, with the valve 17 in the open position. In the example of embodiment shown in FIG. 1, the position of the outflow openings 20*a*, 20*b*, 20*c*, 20*d* has been selected such that, as a breaking operation proceeds, the first of the outflow openings 20*a*, 20*b*, 20*c*, 20*d* will be closed once the first contact 4 has cleared the bottleneck 11.

By the sequential axial arrangement of a number of outflow openings 20*a*, 20*b*, 20*c*, 20*d* one behind the other, an incremental reduction of the cross-sectional area provided by the number of outflow openings 20*a*, 20*b*, 20*c*, 20*d* is achieved. This results in an incremental increase in the overall flow resistance of the outflow openings 20*a*, 20*b*, 20*c*, 20*d*.

The position of the outflow openings 20*a*, 20*b*, 20*c*, 20*d* is selected such that, upon a relative movement of the second rated current contact 7 within the guide bush 8, the rated current contact 7 or the piston/partition 15 will move in front of the outflow openings 20*a*, 20*b*, 20*c*, 20*d*.

The operation of the gas-blast circuit-breaker represented in FIG. 1 is described below, by way of an example. A closing operation is described in the first instance, starting from the position shown in the half-image of FIG. 1 in which the two contacts 4, 5 and the two rated current contacts 6, 7 are separated from each other. In the course of a closing operation, the contacts 4, 5 and the rated current contacts 6, 7 are brought together in galvanic contact.

By means of a drive mechanism, the drive pipe 9 is displaced longitudinally in the axis of symmetry 2, such that the second contact 5 coupled thereto and the second rated current contact 7 are moved in the direction of the corresponding first contact 4 or the corresponding first rated current contact 6. By this motion, the first contact 4 enters the bottleneck 11 of the insulating material nozzle 10. Once the contacts 4, 5, which are in the advanced position, are sufficiently close to each other, "pre-arcing" may occur. Any pre-arcing will be extinguished as the two contacts 4, 5 are brought into galvanic contact.

Upon a breaking operation, a driving motion is applied to the drive pipe 9 such that the latter is displaced longitudinally in the axis of symmetry 2, in the opposite direction to that associated with a closing operation. The two rated current contacts 6, 7 are separated first. At this point, the two contacts 4, 5 are still in galvanic contact. An electric current flowing between the two terminals 3*a*, 3*b* is switched from the conducting path formed between the rated current contacts 6, 7 to the conducting path formed between the contacts 4, 5. The relative movement between the two contacts 4, 5 continues. At a specific point in time, the galvanic separation of the two contacts 4, 5 occurs. As a result of the potential difference between the two terminals 3*a*, 3*b*, an electric current flows via the current circuit and the contacts 4, 5. Upon a corresponding current oscillation, e.g. associated with an alternating e.m.f., the current may be extinguished naturally, in which case there will be no breaking arc. At a correspondingly less favorable point in time, a breaking arc will occur, which burns between the two contacts 4, 5. As a result of the axial extension of the bottleneck 11 in the direction of the axis of symmetry 2, the bottleneck 11 will still be closed by the first contact 4, even after the separation of the two contacts 4, 5. An electric arc burning between the contacts 4, 5 delivers thermal energy to the arc zone and heats electrically insulating gas contained therein, such that the said gas is heated to become switching gas or hot gas. The erosion of insulating material or conductor material may also occur, thereby resulting in the additional formation of a plasma cloud in the arc zone. Overpressure in the arc zone may be reduced e.g. by a flow of hot gas through the drive pipe 9 in the direction of the axis of symmetry 2.

In the vicinity of the electric arc, the feed channel 13 discharges into the bottleneck 11 in a radial direction, such that hot gas is also released from the arc zone via the feed channel 13. The feed channel 13 discharges into the hot gas reservoir volume 14, which is provided with a constant volume. The longer the combustion time of the breaking arc in the arc zone, the more hot gas is delivered into the hot gas reservoir volume 14, thereby resulting in an increase in pressure in the latter associated with the continuing infeed of hot switching gas via the feed channel 13.

During a breaking operation, the motion of the moveable partition 15 which, as a moveable piston, reduces the volume of the compression volume 18, effects the mechanical compression of cold insulating gas contained within the compression volume 18. Reducing the compression volume 18 increases the pressure of cold insulating gas contained within the latter. During the compression process, a quantity of insulating gas may be expelled from the compression volume 18 via the outflow openings 20*a*, 20*b*, 20*c*, 20*d*. However, this quantity can be restricted by the selection of the available cross-section of the outflow openings 20*a*, 20*b*, 20*c*, 20*d*. By a further advancement, the closure of the bottleneck 11 by the first contact 4 is interrupted. The electric arc can continue to burn between the two contacts 4, 5. The interruption of the closure of the bottleneck 11 enables a backflow of the pressurized hot gas contained in the hot gas reservoir volume 14 in the reverse direction via the feed channel 13 into the arc zone where, as a result of the increased flow, the arc is blasted and the plasma cloud contained in the arc zone is removed. By a reduction of the pressure in the hot gas reservoir volume 14, mechanically compressed insulating gas contained in the compression volume 18 can be transferred via the overflow channel 16 to the hot gas reservoir volume 14 and, from thence, can be used for the blasting of the electric arc via the feed channel 13. After an initial clearance of the arc zone by the stored hot gas, the cold insulating gas delivers an additional cooling effect and, accordingly, is particularly suitable for the cooling, blasting and eventual extinction of the hot arc.

As a result of the position of the outflow openings 20*a*, 20*b*, 20*c*, 20*d*, following the interruption of the closure of the bottleneck 11 by the first contact 4, the outflow openings 20*a*, 20*b*, 20*c*, 20*d* are covered in succession by the second rated current contact 7 such that, upon the completion of the breaking movement, an additional increase in the internal pressure of the compression volume 18 can be achieved, as the expulsion of the compressed insulating gas via the outflow openings 20*a*, 20*b*, 20*c*, 20*d* will only now be possible to a reduced extent. The increased pressure in the electrically insulating gas can be relieved by the release thereof into the hot gas reservoir volume 14 via the overflow channel 16.

FIGS. 2 and 3 show alternative configurations for the positions of outflow openings. The operation and construction of the gas-blast circuit-breakers shown in FIGS. 2 and 3 correspond to those of the gas-blast circuit-breaker represented in FIG. 1. In FIG. 2, an alternative positioning of outflow openings 20*e*, 20*f* is provided. Although the outflow openings 20*e*, 20*f* are again incorporated on the shell side of the compression volume 18, the position thereof is selected such that, even in the breaking state, no closure of the outflow openings 20*e*, 20*f* ensues, i.e. the outflow openings 20*e*, 20*f* according to the form of construction shown in FIG. 2 are permanently free of any coverage and, accordingly, are permanently open. In this case, it is particularly important that the flow resistances of the overflow channel 16 and the flow resistances of the outflow openings 20*e*, 20*f* should be matched to each other, such that the flow resistance of the overflow channels 16 is lower (or no more than equal to the flow resistance of the outflow openings 20*e*, 20*f*) than the flow resistance of the outflow opening 20*e*, 20*f*.

FIG. 3 shows an alternative position for outflow openings 20*g*, 20*h*, which are arranged in the stationary end wall 19 of the compression volume 18. In the form of construction shown in FIG. 3, the outflow openings 20*g*, 20*h* are also maintained permanently clear of any covering, valve components or similar, such that their operation corresponds to that of the outflow openings 20*e*, 20*f* represented in FIG. 2. However, the outflow openings 20*g*, 20*h* represented in FIG. 3 effect the transfer or expulsion of compressed insulating gas from the compression volume 18 to the interior of the interrupter unit. The overflow openings 20*h*, 20*g* form a path from the compression volume 18 to a space enclosed by the guide bush 8. By means of corresponding recesses 21 in the guide bush 8, the electrically insulating gas can escape from the interrupter unit through the outflow openings 20*e* 20*g*, 20*h*. By the arrangement of the outflow openings 20*g*, 20*h* in the stationary end wall 19, a reflux wave can be generated within the interrupter unit which can delay the expulsion of compressed insulating gas from the compression volume 18.

The invention claimed is:

1. A gas-blast circuit-breaker, comprising:

a first contact and a second contact forming an arc zone therebetween;

a hot gas reservoir volume;

a feed channel connecting said arc zone to said hot gas reservoir volume;

a variable compression volume;

an overflow channel connecting said hot gas reservoir volume to said variable compression volume;

a wall delimiting said compression volume and having at least one outflow opening incorporated therein, said at least one outflow opening being permanently open, at least in a contacting state of said contacts; and a piston enclosing said compression volume and configured to move relative to said wall for intermittently closing said at least one outflow opening with said piston in a contact breaking operation of said contacts.

2. The gas-blast circuit-breaker according to claim 1, which further comprises a differential pressure-controlled valve disposed along a course of said overflow channel.

3. The gas-blast circuit-breaker according to claim 1, wherein said at least one outflow opening has a flow resistance, and said overflow channel has a flow resistance being equal to or lower than said flow resistance of said at least one outflow opening.

4. The gas-blast circuit-breaker according to claim 1, wherein said wall is configured as a regular cylindrical shell surface of said compression volume.

5. The gas-blast circuit-breaker according to claim 1, wherein said wall is configured as an end face of said compression volume, disposed opposite said piston in a direction of motion of said piston.

* * * * *